United States Patent [19]

Weinzettel et al.

[11] 4,353,124

[45] Oct. 5, 1982

[54] ORNAMENTAL MOUNTING FOR WATCH

[75] Inventors: Michael Weinzettel, St. Louis, Mo.; Walter Weeks, Collinsville, Ill.

[73] Assignee: Eisenstadt Company, St. Louis, Mo.

[21] Appl. No.: 166,484

[22] Filed: Jul. 7, 1980

[51] Int. Cl.[3] ..... G04B 37/00

[52] U.S. Cl. ..... 368/258; 63/29 R; 63/21

[58] Field of Search ..... 368/285, 277, 278; 224/152, 165, 180; 63/1 R, 1 A, 18, 19, 21, 29 R

[56] References Cited

U.S. PATENT DOCUMENTS

| | | | |
|---|---|---|---|
| 313,084 | 3/1885 | Kullman | 63/29 R |
| 403,112 | 5/1889 | Kaffeman | 63/29 R |
| 947,937 | 2/1910 | Porter | 368/285 |
| 1,139,187 | 5/1915 | Kaak | 368/285 |
| 1,553,571 | 9/1925 | Strasser | 368/285 |
| 1,566,976 | 12/1925 | Schmidt | 368/285 |
| 1,991,284 | 2/1935 | Lewbel | 368/277 |
| 2,527,090 | 10/1950 | Bauman | 224/152 |
| 2,557,273 | 6/1951 | Gates | 368/277 |
| 2,566,741 | 9/1951 | Newhouse | 365/285 |
| 4,253,178 | 2/1981 | Kolacia | 368/285 |

FOREIGN PATENT DOCUMENTS

| | | | |
|---|---|---|---|
| 11217 | of 1891 | United Kingdom | 368/278 |
| 306213 | 2/1929 | United Kingdom | 368/285 |

*Primary Examiner*—Bernard Roskoski

*Attorney, Agent, or Firm*—Rogers, Eilers & Howell

[57] ABSTRACT

A housing for a watch has a portion which helps form said housing and which has an annular gallery that comprises a plurality of filigree-forming elements—some of which are circumferentially-displaced threaded sockets to accommodate the male threads of stud-type gem mountings.

11 Claims, 6 Drawing Figures

FIG. 1.
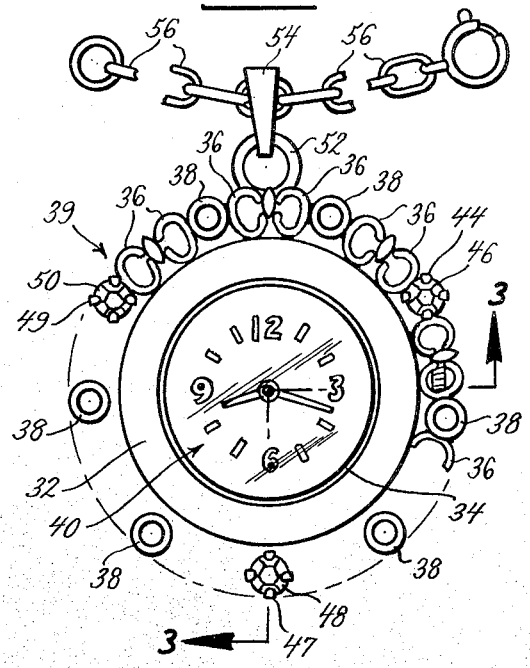
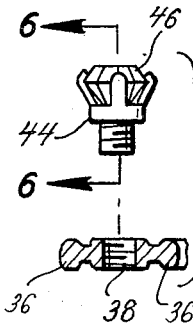
FIG. 5.
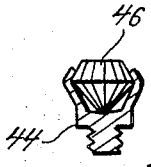
FIG. 6.
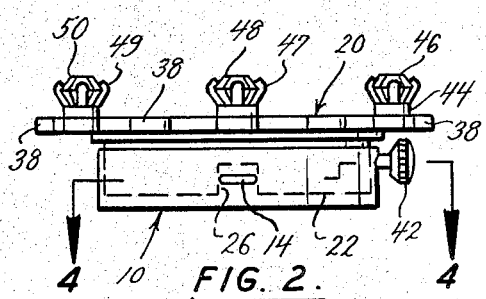
FIG. 2.
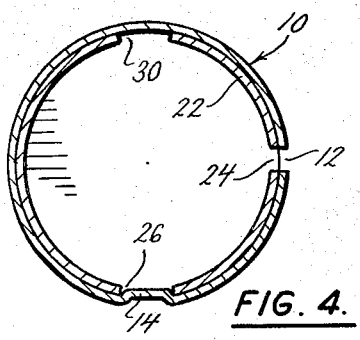
FIG. 4.
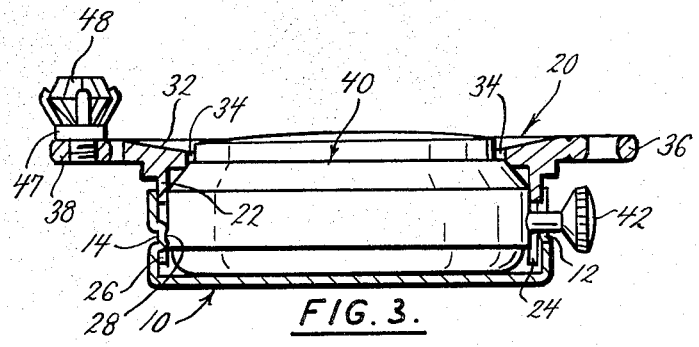
FIG. 3.

ORNAMENTAL MOUNTING FOR WATCH

BACKGROUND OF THE INVENTION:

It is customary to add natural or synthetic gems (hereinafter gems) to jewelry items to commemorate various incidents in the lives of the wearers of those jewelry items or to additionally ornament those jewelry items. For example, it is customary to add gems to rings, necklaces, bracelets, emblems, plaques, brooch pins and watch cases.

SUMMARY OF THE INVENTION:

A housing for a watch has a front portion, a rear portion, interacting surfaces on those portions that normally hold those portions in assembled relation to define a recess in which a watch can be disposed, and an annular gallery which is secured to and which projects outwardly from one of those portions. That gallery has a plurality of filigree-forming elements that coact to provide an ornamental filigree-like configuration for that gallery; and some of those filigree-forming elements are threaded sockets to accommodate stud-type gem mountings which have male threads that can mate with the threads of those said threaded sockets. Those threaded sockets are displaced circumferentially from each other; and differing numbers of the stud-type gem mountings can be set at different circumferentially-displaced positions relating to each other.

Other features and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING:

In the drawing, FIG. 1 is a front elevational view of one preferred embodiment of watch housing that is made in accordance with the principles and teachings of the present invention, and it shows a watch held by that housing and part of a supporting chain for that housing, FIG. 2 is a side elevational view of the housing and watch of FIG. 1, FIG. 3 is a sectional view, on a larger scale, and it is taken along the broken plane indicated by the broken line 3—3 in FIG. 1, FIG. 4 is a sectional view, on the scale of FIG. 1, and it is taken along the plane indicated by the line 4—4 in FIG. 2, FIG. 5 is a partially-sectioned side elevational view, on the scale of FIG. 3, of a gem-supporting stud and a threaded socket therefor, and FIG. 6 is a sectional view, on the scale of FIG. 3, which is taken along the plane indicated by the line 6—6 in FIG. 5.

DETAILED DESCRIPTION OF PREFERRED EMBODIMENT:

The numeral 10 generally denotes a cup-shaped rear portion of a housing for a watch; and that watch is generally denoted by the numeral 40. A notch 12 extends downwardly from the upper edge of the annular wall of the housing portion 10 to accommodate the stem of watch 40, as indicated particularly by FIG. 3. An indentation 14 extends inwardly from the inner surface of the annular wall of the portion 10, as indicated particularly by FIGS. 2–4.

The numeral 20 generally denotes an annular front portion of the watch housing; and it has an arcuate skirt 22. The inner surface of that skirt is dimensioned to snugly accommodate the arcuate wall of the watch 40, as indicated by FIG. 3. The outer surface of that skirt is dimensioned to snugly engage the inner surface of the annular wall of the rear portion 10. A notch 24 extends upwardly from the lower edge of the annular skirt 22 of the front portion 20; and that notch is dimensioned to accommodate the stem of watch 40, as indicated particularly by FIG. 3. As indicated by FIG. 4, the notch 24 and the notch 12 in the annular wall of the rear portion 10 will be set in register to accommodate the watch stem.

The numeral 26 denotes a wider notch which extends upwardly from the lower edge of the annular skirt 22 of the front portion 20; and that notch is dimensioned to accommodate the indentation 14 at the inner face of the annular wall of the rear portion 10, as shown by FIGS. 2 and 4. Also, that notch is dimensioned to accommodate a shallow protuberance 28 on the periphery of the watch 40. A further wide notch 30 is provided in the annular skirt 22 of the front portion 20, as indicated by FIG. 4. That further notch is dimensioned to accommodate a shallow protuberance, not shown, which is identical to, but which is displaced one hundred and eighty degrees from, the shallow protuberance 28. The engagements between the ends of those shallow protuberances and the edges of the notches 26 and 30 will coact with the snug engagement between the watch 40 and the inner surface of the skirt 22 of the front portion 20 to prevent accidental separation of that watch from the front portion. The further notch 30, and the notches 24 and 26, also permit the annular skirt 22 of the front portion 20 to flex to whatever extent is needed to permit that annular skirt to be telescoped over the watch 40 and within the annular wall of the rear portion 10.

The numeral 32 denotes an annular surface which inclines downwardly and inwardly at a shallow angle toward the geometric center of the front portion 20. As indicated by FIG. 3, the rear face of the annular surface 32 overlies and abuts part of the front of the watch 20; and hence it will keep that watch from being moved forwardly out of the watch housing constituted by the front and rear portions 20 and 10. The solid rear face of the rear portion 10 underlies and abuts the rear of the watch 40; and hence it will keep that watch from being moved rearwardly out of that watch housing. The inner diameter of the annular surface 32 is larger than the diameter of the crystal of the watch 40; and hence an annular gap 34 is provided between that annular surface and that crystal. That annular gap provides a pleasing three-dimensional effect for the ensemble constituted by watch 40 and the front portion 20.

The numeral 36 denotes open-type arcuate projections which are secured to and which extend outwardly from the outer periphery of the annular surface 32. Those projections can be made separate from that outer periphery of that annular surface and thereafter secured to it by welding, soldering or brazing operations. The numeral 38 denotes threaded sockets that are circular in configuration, and that are interposed with, and that are welded, soldered, brazed or otherwise secured to, various of the open-type arcuate projections 36. As shown particularly by FIG. 1, the threaded sockets 38 are held, by the open-type projections 36, so they are spaced outwardly from the periphery of the annular surface 32. As shown by FIGS. 1–3, the threaded sockets 38 are small enough so they are completely overlain by, and hence do not detract from the prominence of, the gems.

The open-type arcuate projections 36 coact with the threaded sockets 38 to constitute a continuous, open-type, ornamental gallery 39 which encircles the annular surface 32. As a result, that gallery also encircles the watch 40. The continuous, open-type, ornamental gallery 39 coacts with the annular surface 32, and with the annular gap between that annular surface and the watch crystal, to provide an attractive and ornamental setting for the watch 40.

The numeral 42 denotes a knurled knob on the outer end of the stem of watch 40. That knob is of standard and usual construction; and it can be used to set and wind the watch in the standard and usual manner.

The numeral 44 denotes a threaded stud-type gem mounting which holds a gem 46 -- having four prongs which accommodate and tightly grip that gem. The male thread on the stud of that gem mounting is dimensioned to be threaded into the female thread of any of the threaded sockets 38. Stud-type gem mountings 47 and 49 hold further gems 48 and 50.

The numeral 52 denotes an "eye" which is part of, but which projects outwardly beyond the periphery of, the gallery 39, as shown by FIG. 1. A resilient clip 54, of standard and usual design, can be connected to the "eye" 52 by slipping a portion of that clip through that "eye". A chain or necklace 56 can then be passed through the clip 54 and used to suspend the watch housing from a user's neck.

The continuous open-type gallery 39 is ornamental and attractive in appearance even when no stud-type gem mountings are secured in any of the threaded sockets 38 of that gallery. Consequently, the watch housing can be sold with a watch held therein -- and hence can be sold at a price which is relatively low, because that price does not include any stud-type gem mountings. Usually, however, the watch housing will be sold with a watch and with one or more stud-type gem mountings set within threaded sockets 38. When just one stud type gem mounting is used with the gallery 39, that mounting usually will be located in the position which is occupied by the gem-supporting stud 47 in FIG. 1. Such an arrangement provides a desirable balance and symmetry for the watch and the gallery 39. When two stud-type gem mountings are used with the gallery 39, those mountings will usually be disposed in the threaded sockets immediately below the stud-type gem mountings 44 and 49 of FIG. 1. Such an arrangement also provides a pleasing and attractive balance and symmetry. Where, as indicated by the drawing, three stud-type gem mountings are used with the gallery 39, those mountings will usually be arranged in the positions occupied by the stud-type gem mountings 44, 47 and 49. Such an arrangement provides an attractive and pleasing symmetry. The foregoing numbers and arrangements of stud-type gem mountings are merely illustrative; and up to nine stud-type gem mountings can be used with the gallery 39. Moreover, because almost any desired spacing and selection of gems can be effected, a large number of permutations and combinations are possible. The stud-type gem mountings are easily threaded into position within any of the threaded sockets 38; and, once they have been threaded into those sockets, the mountings will resist accidental separation from those sockets. However, whenever it is desirable to relocate or replace any of those stud-type gem mountings, it is a simple matter to rotate them until they are freed from their threaded sockets.

There are nine threaded sockets 38 incorporated into the gallery 39. As a result, a total of nine events in a wearer's life can be commemorated by appropriate selection of gems for the stud-type gem mountings. Because people frequently relate significant events to the months in which they occur, twelve differently-colored gems are provided in the stud-type gem mountings. Various combinations of those gems can be secured to the gallery of a wearer's watch housing to commemorate many significant events in that wearer's life.

Whereas the drawing and accompanying description have shown and described a preferred embodiment of the present invention, if should be apparent that various changes may be made in the form of the invention without affecting the scope thereof.

What I claim is:

1. A housing for a watch which comprises a front portion, a rear portion, interacting surfaces on said portions that normally hold said portions in fixedly-assembled relation throughout the time said watch is held by said housing, said portions coacting to define a recess in which said watch can be disposed and held when said portions are in assembled relation, said front portion having an opening therein through which the time-indicating elements of said watch can be viewed while said interacting surfaces on said portions hold said portions in fixedly-assembled relation, an annular gallery which is fixedly secured to and which fixedly projects laterally outwardly from one of said portions, said annular gallery being spaced outwardly relative to said opening in said front portion to assure ready viewing of said time-indicating elements of said watch while said interacting surfaces on said portions hold said portions in fixedly-assembled relation, said annular gallery comprising a plurality of filigree-forming elements that coact to provide an ornamental filigree-like configuration for said annular gallery, some of said filigree-forming elements being stud-receiving sockets with holding surfaces therein which are formed and dimensioned to accommodate and to hold complementary surfaces on the studs of stud-type gem mountings which have gems projecting forwardly from the fronts thereof and which have the studs thereof extending rearwardly therefrom to have said complementary surfaces thereon disposable within and held by said holding surfaces in said stud-receiving sockets to hold said gems forwardly of said stud-receiving sockets, said stud-receiving sockets being spaced outwardly and away from said opening in said front portion and hence outwardly and away from said time-indicating elements of said watch and said gems being dimensioned so they are disposed outwardly and away from said opening in said front portion and hence outwardly and away from said time-indicating elements of said watch whenever said studs of said stud-type gem mountings are within said stud-receiving sockets, whereby said stud-receiving sockets and said gems permit full and free viewing of said time-indicating elements of said watch while said interacting surfaces on said portions hold said portions in fixedly-assembled relation, said stud-receiving sockets being displaced circumferentially from each other, whereby one or more of said stud-type gem mountings can be disposed at different locations circumferentially of said annular gallery to dispose one or more of said gems at different locations circumferentially of said annular gallery, said annular gallery enclosing said watch by enclosing said opening in said front portion, whereby said annular gallery can make said watch a center of interest within a gem-studded filigree-like annular gallery, each of said stud-receiving sockets having filigree-forming elements adjacent thereto so said stud-type gem mountings hold said gems adjacent exposed and visible filigree-forming elements of said annular gallery whenever said complementary surfaces on said studs are disposed within and held by said holding surfaces in said stud-receiving sockets, said annular gallery having an area which is much larger than the area of any of said stud-receiving sockets so substantial portions of said filigree-forming elements will be exposed to view even after the stud of a stud-type gem mounting is disposed within and held by one of said stud-receiving sockets.

2. A housing as claimed in claim 1 wherein said front portion has a surface which engages said watch to keep said watch from being moved forwardly out of said housing, and wherein said rear portion has a surface which engages said watch to keep said watch from being moved rearwardly out of said housing.

3. A housing as claimed in claim 1 wherein said filigree-forming elements are arcuate in plan, and wherein said sockets are arcuate in plan.

4. A housing for a watch which comprises a front portion, a rear portion, interacting surfaces on said portions that normally hold said portions in fixedly-assembled relation throughout the time said watch is held by said housing, said portions coacting to define a recess in which said watch can be disposed and held when said portions are in assembled relation, said front portion having an opening therein through which the time-indicating elements of said watch can be viewed while said interacting surfaces on said portions hold said portions in fixedly-assembled relation, an annular gallery which is fixedly secured to and which fixedly projects laterally outwardly from one of said portions, said annular gallery being spaced outwardly relative to said opening in said front portion to assure ready viewing of said time-indicating elements of said watch while said interacting surfaces on said portions hold said portions in fixedly-assembled relation, said annular gallery comprising a plurality of filigree-forming elements that coact to provide an ornamental filigree-like configuration for said annular gallery, some of said filigree-forming elements being stud-receiving sockets with holding surfaces therein which are formed and dimensioned to accommodate and to hold complementary surfaces on the studs of stud-type gem mountings which have gems projecting forwardly from the fronts thereof and which have the studs thereof extending rearwardly therefrom to have said complementary surfaces thereon disposable within and held by said holding surfaces in said stud-receiving sockets to hold said gems forwardly of said stud-receiving sockets, said stud-receiving sockets being spaced outwardly and away from said opening in said front portion and hence outwardly and away from said time-indicating elements of said watch and said gems being dimensioned so they are disposed outwardly and away from said opening in said front portion and hence outwardly and away from said time-indicating elements of said watch whenever said studs of said stud-type gem mountings are within said stud-receiving sockets, whereby said stud-receiving sockets and said gems permit full and free viewing of said time-indicating elements of said watch while said interacting surfaces on said portions hold said portions in fixedly-assembled relation, said stud-receiving sockets being displaced circumferentially from each other, whereby one or more of said stud-type gem mountings can be disposed at different locations circumferentially of said annular gallery to dispose one or more of said gems at different locations circumferentially of said annular gallery, said annular gallery enclosing said watch by enclosing said opening in said front portion, whereby said annular gallery can make said watch a center of interest within a gem-studded filigree-like annular gallery, each of said stud-receiving sockets being interposed with, and being secured to, said filigree-forming elements, whereby said stud-type mountings are disposable against, and hold said gems adjacent, a background constituted by exposed and visible filigree-forming elements of said filigree-like annular gallery whenever said complementary surfaces on said studs are disposed within and held by said holding surfaces in said stud-receiving sockets, said annular gallery having an area which is much larger than the area of any of said stud-receiving sockets so substantial portions of said filigree-forming elements will be exposed to view even after the stud of a stud-type gem mounting is disposed within and held by one of said stud-receiving sockets.

5. A housing as claimed in claim 1 wherein said filigree-forming elements hold said sockets spaced outwardly from said one portion.

6. A housing as claimed in claim 1 wherein said sockets can be completely overlain by the gems of said stud-type gem mountings, whereby said sockets will not detract from the prominence of said gems.

7. A housing as claimed in claim 1 wherein said sockets have threads therein, and wherein said studs of stud-type gem mountings have mating threads thereon.

8. A housing as claimed in claim 1 wherein said one portion has an annular surface that extends inwardly from said filigree-like annular gallery.

9. A housing as claimed in claim 1 wherein said one portion has an annular surface that extends inwardly from said filigree-like annular gallery whereby said annular surface overlies part of the front of said watch when said watch is placed in said housing to keep said watch from being moved forwardly out of said housing.

10. A housing for a watch which comprises a front portion, a rear portion, interacting surfaces on said portions that normally hold said portions in fixedly-assembled relation throughout the time said watch is held by said housing, said portions coacting to define a recess in which said watch can be disposed and held when said portions are in assembled relation, said front portion having an opening therein through which the time-indicating elements of said watch can be viewed while said interacting surfaces on said portions hold said portions in fixedly-assembled relation, an annular gallery which is fixedly secured to and which fixedly projects laterally outwardly from one of said portions, said annular gallery being spaced outwardly relative to said opening in said front portion to assure ready viewing of said time-indicating elements of said watch while said interacting surfaces on said portions hold said portions in fixedly-assembled relation, said annular gallery comprising a plurality of filigree-forming elements that coact to provide an ornamental filigree-like configuration for said annular gallery, some of said filigree-forming elements being stud-receiving sockets with holding surfaces therein which are formed and dimensioned to releasably accommodate and to releasably hold complementary surfaces on the studs of stud-type gem mountings which have gems projecting forwardly from the fronts thereof and which have the studs thereof extending rearwardly therefrom to have said complementary surfaces thereon releasably disposable within and releasably held by said holding surfaces in said stud-receiving sockets to releasably hold said gems forwardly of said stud-receiving sockets, said stud-receiving sockets being spaced outwardly and away from said opening in said front portion and hence outwardly and away from said time-indicating elements of said watch and said gems being dimensioned so they are disposed outwardly and away from said opening in said front portion and hence outwardly and away from said time-indicating elements of said watch whenever said studs of said stud-type gem mountings are releasably held within said stud-receiving sockets, whereby said stud-receiving sockets and said gems permit full and free viewing of said time-indicating elements of said watch while said interacting surfaces on said portions releasably hold said portions in fixedly-assembled relation, said stud-receiving sockets being displaced circumferentially from each other, whereby one or more of said stud-type gem mountings can be releasably disposed at different locations circumferentially of said annular gallery to releasably dispose one or more of said gems at different locations circumferentially of said annular gallery, said annular gallery enclosing said watch by enclosing said opening in said front portion, whereby said annular gallery can make said watch a center of interest within a gem-studded filigree-like annular gallery, said stud-type gem mountings being releasably disposable within said sockets, whereby said stud-type gem mountings can be releasably set within and subsequently removed from various of said stud-receiving sockets to provide desired different arrangements of said stud-type gem mountings on said filigree-like annular gallery, each of said stud-receiving sockets having filigree-forming elements adjacent thereto so said stud-type gem mountings releasably hold said gems adjacent exposed and visible filigree-forming elements of said annular gallery whenever said complementary surfaces on said studs are disposed within and releasably held by said holding surfaces in said stud-receiving sockets, said annular gallery having an area which is much larger than the area of any of said stud-receiving sockets so substantial portions of said filigree-forming elements will be exposed to view even after the stud of a stud-type gem mounting is releasably disposed within and held by one of said stud-receiving sockets.

11. A housing as claimed in claim 1 wherein portions of said filigree-like annular gallery project outwardly beyond both said front portion and said rear portion.

* * * * *